United States Patent [19]

May

[11] Patent Number: 4,467,403

[45] Date of Patent: Aug. 21, 1984

[54] TWIN BEAM PORTABLE LIGHT ASSEMBLY

[75] Inventor: Richard L. May, Manhattan Beach, Calif.

[73] Assignee: Allen Group, Inc., Compton, Calif.

[21] Appl. No.: 483,893

[22] Filed: Apr. 11, 1983

[51] Int. Cl.[3] ..... F21V 21/32

[52] U.S. Cl. ..... 362/250; 362/191; 362/285; 362/430; 362/295; 362/184; 362/370; 362/432; 362/226; 362/399; 362/450; 362/239; 362/427; 362/200

[58] Field of Search ..... 362/183–185, 362/190, 191, 200, 240, 250, 372, 450, 11, 109, 295, 287, 322, 430, 432, 239, 285, 370, 399, 226, 427

[56] References Cited

U.S. PATENT DOCUMENTS

| | | | |
|---|---|---|---|
| 1,443,748 | 1/1923 | Kahns et al. | 362/287 X |
| 1,647,149 | 11/1927 | Ryan | 362/308 |
| 2,861,174 | 11/1958 | Talbot et al. | 362/184 X |
| 2,987,718 | 6/1961 | Davis | 362/183 X |
| 3,519,811 | 7/1970 | Jacobs | 362/426 X |
| 4,048,631 | 9/1977 | Flores | 362/184 X |
| 4,075,470 | 2/1978 | Moore | 362/287 |
| 4,167,783 | 9/1979 | Mitchell | 362/236 |
| 4,298,907 | 11/1981 | Holt, Jr. | 362/450 X |
| 4,392,183 | 7/1983 | Östlund et al. | 362/450 X |

*Primary Examiner*—Peter A. Nelson

*Attorney, Agent, or Firm*—I. Michael Bak-Boychuk

[57] ABSTRACT

A portable light assembly conformed for excitation from the cigarette lighter outlet of an automobile comprises two light housings each universally pivoted from a central handle assembly. The central assembly includes opposed pivot fittings from which two laterally disposed swivel blocks are pivoted, each swivel block in turn pivotally supporting a corresponding light. In this form the alignment of each light may be individually selected to produce any desired beam pattern, the same pivotal freedom providing for a collapsed alignment where the lens portions of each light are protected from damage.

4 Claims, 5 Drawing Figures

TWIN BEAM PORTABLE LIGHT ASSEMBLY

BACKGROUND OF THE INVENTION

1. Field of the Invention

The present invention relates to portable light assemblies, and more particularly to portable lights provided with alignment mechanisms for directing the beam thereof.

2. Description of the Prior Art

Portable light sources provided with their own power sources or powered through extension cords have been known in the past. Typically such light sources in order to obtain maximum illumination entail narrow beam configurations with the result that certain areas onto which such sources are directed are illuminated too much while others remain insufficiently illuminated. As result the use of such light sources in the course of roadside repairs, for example, is often less than comfortable since the glare of a high intensity narrow beam renders the surrounding areas much less visible.

On the other hand the use of plural light source arrangements has been found to produce shadow patterns which are less intense, more closely approximating the scattering of light that normally occurs in daytime. Thus lighting arrangements entailing more than one light source provide a more comfortable manner of illumination. In addition such lighting arrangements provide control over the beam pattern developed at distance allowing for more or less overlapping as conditions demand.

Thus a portable light assembly having the foregoing advantages has been sought in the past. It is one such assembly, conformed for convenient storage, that is disclosed herein.

SUMMARY OF THE INVENTION

Accordingly, it is the general purpose and object of the present invention to provide a portable light assembly including a plurality of articulated light sources.

Other objects of the invention are to provide a portable light assembly including a plurality of light sources selectively aligned to form an illumination pattern.

Yet additional objects of the invention are to provide a lighting assembly including a plurality of articulated lights conformed for collapsed storage.

Briefly these and other objects are accomplished within the present invention by providing a central support structure of substantially rectangular configuration including opposed pivot fittings formed in the lateral edges thereof. Attached for pivotal articulation to the pivot fittings are two swivel blocks each conformed to support in hinged relationship a corresponding light assembly. The pivotal attachment and the hinged articulation of the swivel blocks may be selectively fixed by thumb screws thus fixing the relative alignment of the corresponding light assemblies. In this manner any desired beam pattern may be developed by the combination of the beams either to eliminate shadow contrast on close work or to expand the illuminated area at distance.

To achieve further conveniences the central support structure may include a handle provided with a selector switch by which one or the other, or both, of the light assemblies are turned on. The central structure, furthermore, may house such storage batteries as are required or any extension cords for external excitation. All these features are contained in a structure dimensioned to allow pivotal collapse of the light assemblies against each other thus forming a convenient arrangement during transport where the glass lenses of each light are protected from damage.

DESCRIPTION OF THE PREFERRED EMBODIMENT

Figure 1:
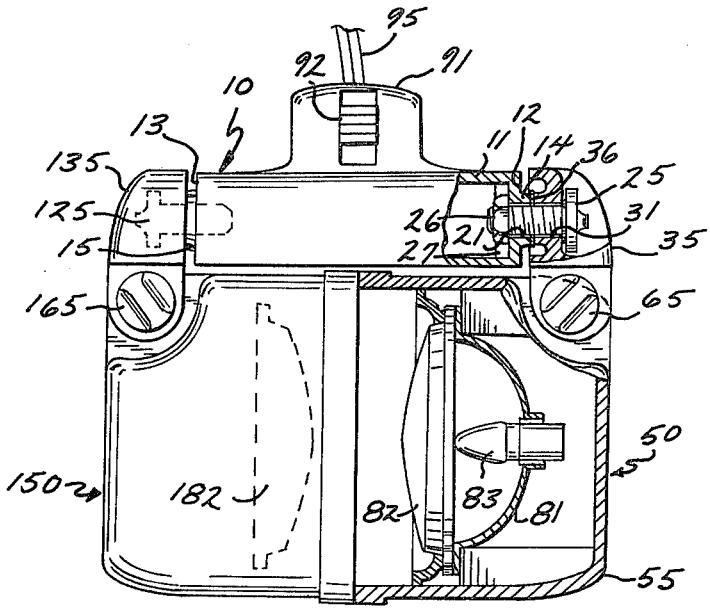
FIG. 1 is a top view of the inventive light assembly shown in collapsed form for transport.
Figure 2:
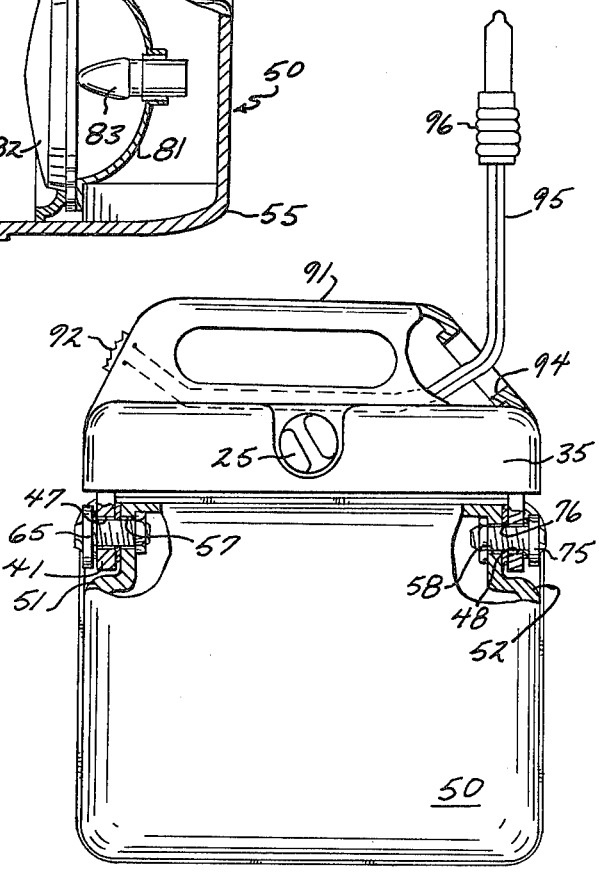
FIG. 2 is a perspective illustration of the light assembly shown in FIG. 1 illustrating the alignment thereof when deployed.
Figure 3:
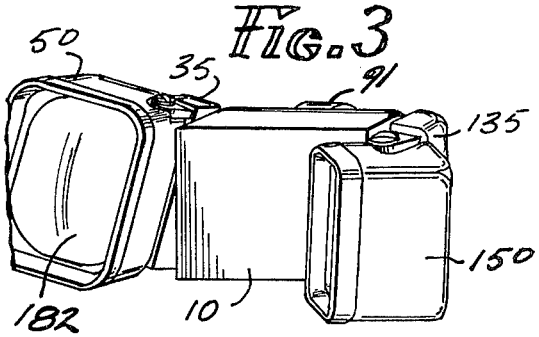
FIG. 3 is an end view illustration of the inventive light assembly including detail sections of the hinging mechanism therein.

As shown in FIGS. 1, 2 and 3 the inventive light assembly, generally designated by the numeral 10, comprises a central support segment 11 of substantially rectangular plan form provided with two opposed lateral edge surfaces 12 and 13 each including a corresponding outwardly directed pivot boss 14 and 15. Boss 14, and by direct similarity boss 15, includes in the center thereof a pivot bore 21 conformed to receive the shank of a pivot thumbscrew 25. Screw 25 thus passes to the interior of segment 11 to threadably engage thereat a nut 26 fixed against rotation by a set of radial ribs 27 formed around the inner end of bore 21. Thus thumbscrew 25 may be selectively loosened and tightened to release or set the pivotal articulation thereof within bore 21. Concurrent with the passage through bore 21 setscrew 25 also passes through yet another bore 31 extending through an elongate swivel block 35 separated from boss 14 by a compressible friction washer 36. In this manner each time the thumbscrew is loosened pivotal motion of the swivel block 35 can take place which then can be fixed at the selected angular alignment by the subsequent tightening of the thumbscrew.

A second degree of angular rotation may then be implemented by way of two forwardly directed pivot tabs 41 and 42 respectively extending from the upper and lower end of swivel block 35 spaced to receive therebetween a light assembly 50. In more detail, assembly 50 comprises a hollow housing 55 provided with depressed recesses 51 and 52 at the upper and lower end of one edge thereof. It is the separation between these recesses that is conformed to the spacing dimension between tabs 41 and 42. In a manner similar to the pivotal attachment of block 35 to segment 11 the upper tab 41 may include a circular opening 47 aligned with an opening 57 in recess 51 to receive a thumbscrew 65 through the common interior thereof. Once again a friction washer 61 may be interposed between tab 41 and recess 51 and a nut 66 may be fixed subjacent the recess to threadably engage the thumbscrew 65.

At the other end a pivot pin 75 may be pressed through the common interior of holes 48 and 58 formed respectively in tab 42 and recess 52, pin 75 including a wedge shaped ring 76 about the lateral surface thereof which upon passing through opening 48 opposes subsequent withdrawal. Thus a second degree of angular alignment is provided by way of the selective loosening and tightening of thumbscrew 75 which together with the pivotal motion about thumbscrew 25 gives a full range of angular alignment of the light assembly 50.

Assembly 50 may include a reflector dish 81 mounted within housing 51 and exposed through a lens 82 covering one side of the housing. The reflector dish 81 may include a lamp 83 in the center thereof positioned to develop an illuminating beam when excited.

In a similar manner boss 15 supports a swivel block 135 retained by a thumbscrew 125, block 135 supporting a light assembly 150 provided with a lens 182. In the foregoing arrangement the common transverse dimensions across assemblies 50 and 150 are such that the assemblies may be pivoted against each other when stored. In this manner the fragile lenses are protected from damage forming a convenient package for transport.

To further enhance the convenience the center segment 11 may be provided with a handle 91 including a multiposition switch 92 by which either of the lamp assemblies 50 and 150, or both together, may be connected for excitation. Handle 91, furthermore, may include a recess 94 in which an extension cord 95 terminating in a cigarette lighter plug 96 is stored. Cord 95, in turn, may then connect to the switch 92, providing the necessary electrical excitation.

Figure 4:
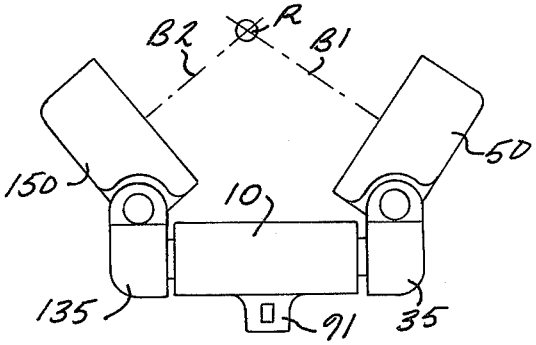
FIG. 4 is a diagrammatic illustration of one beam pattern available from the inventive light assembly particularly suited for close work.
Figure 5:
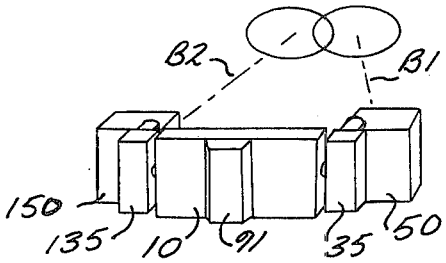
FIG. 5 is yet another beam diagram, suited for illumination of remote objects.

In the foregoing arrangement assemblies 50 and 150 may be variously tilted and fixed in alignment relative the center segment 11. Thus as shown in FIGS. 4 and 5 either a crossing beam pattern of beams B1 and B2 emanating from assemblies 50 and 150 may be developed, illuminating the shadows behind a proximate object R or a compound beam pattern may be developed at distance. Accordingly, the inventive assembly both lends itself to close work and for selective illumination at distance. Furthermore, the shaping of the various reflectors may be selected to develop various levels of beam divergence thus providing for a full range of options.

Obviously many modifications and changes may be made to the foregoing description without departing from the spirit of the invention. It is therefore intended that the scope of the invention be determined solely on the claims appended hereto.

I claim:

1. A portable lighting assembly conformed for electrical excitation and pivoted to collapse for storage, comprising:

a substantially rectangular center section including a first and second lateral edge surface each provided with an opposed pivot mount proximate the center thereof;

a first and second swivel block arranged for pivotal engagement to the respective ones of said pivot mounts in said first and second edge surfaces each said swivel block being of an elongate conformation substantially equal to the corresponding ones of said first and second lateral edges;

pivotal engaging means deployed to engage said first and second swivel block to the corresponding ones of said pivot mounts in said first and second lateral edge surfaces, said engaging means including manually securing operable means for selectively fixing the pivotal motion of said first and second edge surfaces;

a first and second light assembly of substantially rectangular shape hinged along one edge thereof from the corresponding ones of said first and second swivel blocks for articulation from a first position adjacent said center section to a second position distal thereof; and manually operable fixing means deployed between said first and second light source and the corresponding ones of said first and second swivel blocks for selective fixing of the relative hinging articulation thereof.

2. Apparatus according to claim 1 wherein:

said center section includes a handle conformed for manual transportation thereof.

3. Apparatus according to claim 2 wherein:

said center section is conformed to a transverse dimension substantially equal to the transverse dimension across said first and second light source when hinged into opposing alignment.

4. Apparatus according to claim 3 wherein:

said handle includes a manually operable electrical switch.

* * * * *

Disclaimer 4,467,403.—*Richard L. May*, Manhattan Beach, Calif. TWIN BEAM PORTABLE LIGHT ASSEMBLY. Patent dated Aug. 21, 1984. Disclaimer filed Mar. 29, 1989, by the assignee, Mr. Gasket Co.

Hereby enters this disclaimer for the entire term of said patent.

[ *Official Gazette June 27, 1989* ]